United States Patent [19]

Brinkerhoff

[11] 4,295,335

[45] Oct. 20, 1981

[54] REGENATIVE ABSORPTION ENGINE APPARATUS AND METHOD

[76] Inventor: VerDon C. Brinkerhoff, 917 Park Row, Salt Lake City, Utah 84105

[21] Appl. No.: 39,035

[22] Filed: May 14, 1979

Related U.S. Application Data

[63] Continuation-in-part of Ser. No. 868,117, Jan. 9, 1978, abandoned.

[51] Int. Cl.[3] ..... F01K 25/06

[52] U.S. Cl. ..... 60/673; 60/649; 159/13 B; 202/236; 261/153

[58] Field of Search ..... 60/649, 673; 261/153, 261/155; 202/236, 158; 159/13 B; 203/89

[56] References Cited

U.S. PATENT DOCUMENTS

| | | | |
|---|---|---|---|
| 337,371 | 3/1886 | Campbell | 60/649 |
| 427,398 | 5/1890 | Campbell | 60/649 |
| 3,505,810 | 4/1970 | Mamiya | 60/649 X |
| 4,183,218 | 1/1980 | Eberly, Jr. | 60/673 |

*Primary Examiner*—Allen M. Ostrager
*Assistant Examiner*—Stephen F. Husar
*Attorney, Agent, or Firm*—H. Ross Workman; J. Winslow Young; Allen R. Jensen

[57] ABSTRACT

A regenative absorption engine apparatus and method, the apparatus including a closed cycle system having a first fluid and a second fluid, the first fluid having a relatively lower boiling point, the second fluid having a relatively higher boiling point and also a relatively high degree of absorptivity for the first fluid. The apparatus further includes a distillation column, a superheater, a mechanical expansion engine, an absorption column, and heat exchange apparatus. The distillation column is used to separate the first fluid from the second fluid with heat while the superheater increases the thermal energy of the first fluid prior to passing the first fluid through the mechanical expansion engine. The mechanical expansion engine converts thermal energy in the first fluid to mechanical energy. The backpressure in the first fluid on the downstream side of the mechanical expansion engine is lowered by absorbing the first fluid with the second fluid in the absorption column. Additional economies can also be realized by using the second fluid from the distillation column to superheat the first fluid.

11 Claims, 5 Drawing Figures

REGENERATIVE ABSORPTION ENGINE APPARATUS AND METHOD

RELATED APPLICATIONS

This application is a continuation-in-part application of my copending application Ser. No. 868,117 filed Jan. 9, 1978, now abandoned, for REGENERATIVE ABSORPTION ENGINE.

BACKGROUND

1. Field of the Invention

This invention relates to external combustion engine apparatus and, more particularly to a closed cycle, twofluid, regenative absorption engine apparatus and method.

2. The Prior Art

Conventional external combustion engines utilize heat energy from a combustion source to vaporize a single working fluid and direct the same to a mechanical expansion engine where the thermal energy is converted to mechanical energy. Customarily, the working fluid is directed from the mechanical expansion engine to a condensing apparatus to condense the working fluid prior to returning the same to the boiler. It is well-known that a substantial backpressure exists in the system upstream of the condenser thereby substantially lowering the thermal efficiency of the system.

Dual fluid systems such as ammonia/water are well-known in the art and are used for various applications, primarily in the field of refrigeration. However, until the present invention, none of the prior art systems has utilized a closed vapor standard heat engine to convert thermal energy into mechanical energy wherein the first, working fluid is superheated and the second fluid has a relatively high degree of absorptivity for the working fluid so as to lower the backpressure on the downstream side of the expansion engine.

It would, therefore, be a significant advancement in the art to provide a closed vapor standard heat engine for converting thermal energy to mechanical energy wherein a dual fluid system is utilized, one of the fluids having a relatively high degree of absorptivity for the other fluid. It would also be an advancement in the art to provide a regenative absorption engine including apparatus for recovering at least part of the heat of absorption by regeneration. It would also be an advancement in the art to provide a regenative absorption engine wherein the working fluid is superheated prior to being introduced into the expansion engine. Such a novel apparatus and method is disclosed and claimed herein.

BRIEF SUMMARY AND OBJECTS OF THE INVENTION

The present invention relates to a novel regenative absorption engine apparatus and method wherein a relatively low boiling point first fluid and a higher boiling point second fluid are contained within a closed cycle, the second fluid having a relatively high degree of absorptivity for the first fluid. The fluids are separated by heat in a distillation column to produce a first, working fluid vapor and a second, absorption fluid. The working fluid vapor is superheated and directed to an expansion engine where a portion of the thermal energy contained therein is converted into mechanical energy. The efficiency of the system is enhanced by absorbing the first, working fluid with the second, absorption fluid and recovering part of the heat of absorption by regeneration. Heat exchanger apparatus are utilized for recovering a fairly large degree of the thermal energy in the system.

It is, therefore, a primary object of this invention to provide improvements in regenative absorption engines.

Another object of this invention is to provide an improved method for converting thermal energy into mechanical energy.

Another object of this invention is to provide a regenative absorption engine wherein a first, working fluid is vaporized and superheated prior to introducing the same into a mechanical expansion engine and the backpressure downstream of the mechanical expansion engine is reduced by absorbing the working fluid with the absorption fluid.

Another object of this invention is to provide a regenative absorption engine apparatus wherein the thermal energy is substantially recovered through heat exchange apparatus.

Another object of this invention is to provide novel apparatus for distillation, superheating, and absorption.

These and other objects and features of the present invention will become more fully apparent from the following description and appended claims taken in conjunction with the accompanying drawing.

DETAILED DESCRIPTION OF THE PREFERRED EMBODIMENTS

Figure 1:
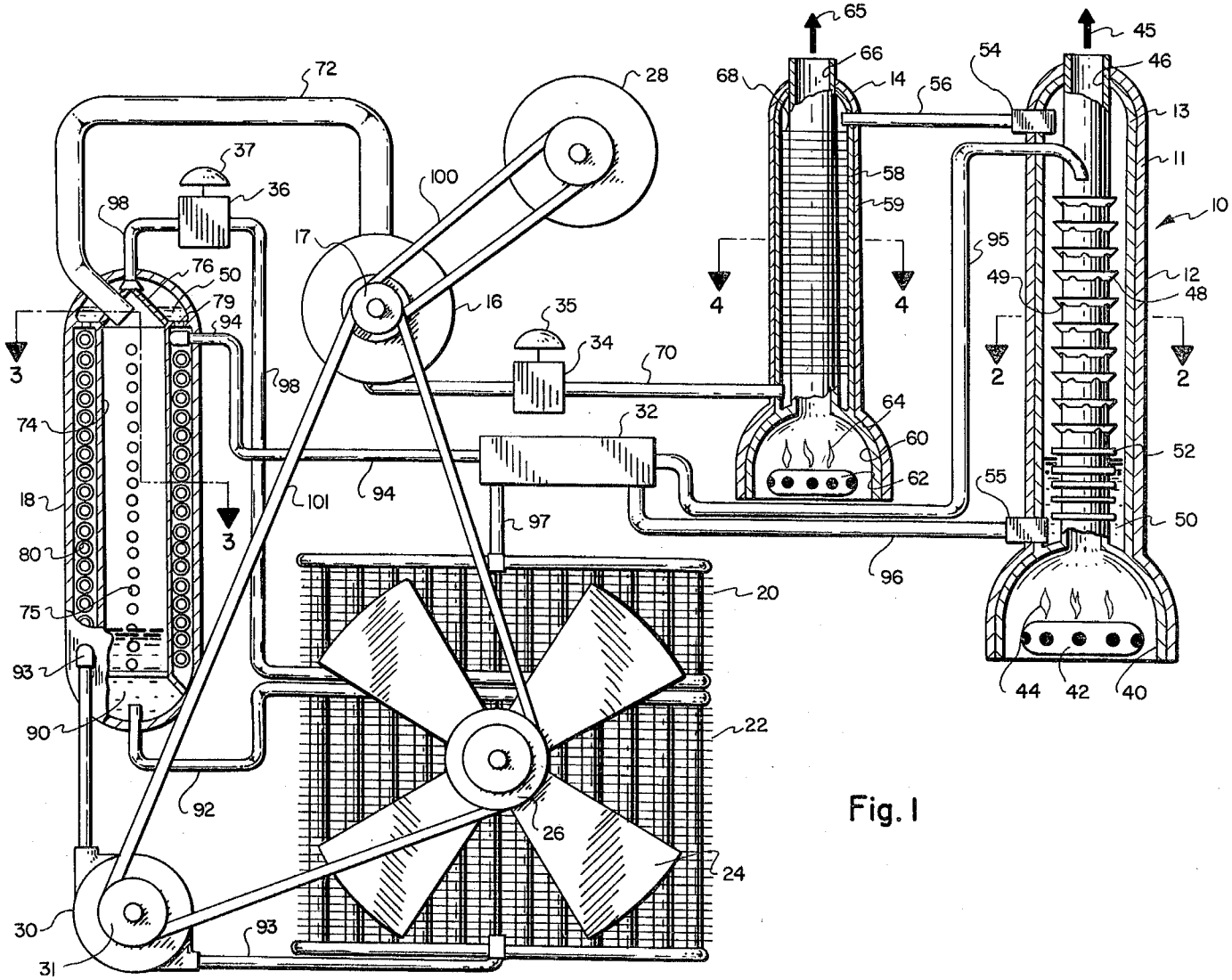
FIG. 1 is a schematic view of the apparatus of the present invention with portions shown in cross-section and broken away for ease of illustration and understanding.

The invention is best understood by reference to the drawing wherein like parts are designated with like numerals throughout.

GENERAL DISCUSSION

Distillation is a method of separating the components of a solution which depends upon the distribution of all the substances between a gaseous phase and a liquid phase, and is applied to cases where both components are present in both phases. Instead of introducing a new substance into the mixture in order to provide the second phase, as is done in gas absorption or desorption, the new phase is created from the original solution by vaporization or condensation. Distillation is, therefore, concerned with the separation of solutions where all of the components are appreciably volatile. A prime example in this category is the separation of the components of a liquid solution of ammonia and water. By contacting the ammonia-water solution with air which is essentially insoluble in the liquid, the ammonia may be stripped or desorbed by processes well-known in the art. However, the ammonia, when mixed with water vapor and air, is not obtained in pure form. On the other hand, by the application of heat, the solution may be partially vaporized and thereby create a gas phase consisting of nothing but water and ammonia. And since the gas will be richer in ammonia than the residual liquid, a certain amount of separation will have resulted. By appropriate manipulation of the phases, or by repeated vaporizations and condensations, it is then ordinarily possible to make as complete a separation as may be desired recovering both components of the mixture in as pure a state as desirable.

In distillation, therefore, the new phase differs from the original by its heat content, but heat is readily added or removed without difficulty, although of course the cost in doing this must inevitably be considered. Much technical literature is available on multicomponent systems, particularly binary liquid-vapor equilibrium diagrams wherein the relationship between pressure, temperature, and composition of the mixture has been thoroughly studied and analyzed for numerous compositions.

Distillation is conventionally achieved by distilling the combined solution in an insulated, high-pressure distiller to produce a vapor (working fluid) from an absorption solution, leaving the solvent-rich second fluid as a bottom product. Heat is transferred into the solution to create the separation, the vaporized fluid being conducted through a one-way valve where it is further treated as the working fluid. Additional heat energy can be imparted to the working fluid by a superheater arrangement which can either be in the form of a heat exchanger or may also obtain the heat energy from an external combustion source.

The heated working fluid is then directed to a mechanical expansion engine apparatus for the purpose of converting the thermal energy of the heated working fluid into mechanical energy. Numerous devices primarily in the form of turbines and the like, are utilized for this purpose. The mechanical energy may be used for various purposes but is primarily used to generate electrical power.

Downstream of the mechanical expansion engine, the working fluid is absorbed by the solvent as the absorption liquid to form an absorption solution. The heat of absorption is usually captured and selectively utilized. Gas absorption is the operation in which the gas is contacted with a liquid for the purpose of dissolving the gas with the liquid to provide the absorption solution. These systems are chosen such that the working fluid vapors are readily dissolved or otherwise absorbed in the solution with little difficulty. The solubility of the gaseous phase into the liquid is generally determined by the partial pressures involved as well as the temperatures. Additionally, it is generally known that the solution of a gas results in the evolution of heat and it further follows that in most cases, the solubility of a gas decreases with increasing temperature. One such system that is well-known in the art and for which much technical information is available is, again, that of the ammoniawater system.

Referring now more particularly to FIG. 1, the regenative absorption engine apparatus of this invention is shown generally at 10 and includes a distiller 12, a superheater 14, a mechanical expansion engine 16, an absorption column 18, and coolers 20 and 22. The apparatus further includes a pump 30, heat exchanger 32, and control valves 34 and 36.

The distillation apparatus or distiller 12 is configurated with a cylindrical internal shell 13 having an insulative layer 11 formed on the external surface. A burner housing 40 is formed at the base thereof and includes a burner 42 with flames 44 indicated schematically issuing therefrom. Burner housing 40 is interconnected with a tubular, coaxial flue 46 for directing combustion products 45 upwardly through distiller 12. The lower end of flue 46 includes a plurality of circumferential, heat transfer discs 52 while the upper end includes a plurality of frusto-conical distributor rings 48 having apertures 49 therein. Apertures 49 of each distributor ring 48 are offset from the apertures in the next-succeeding distributor ring 48 to thereby accommodate liquid dispersion against flue 46. Liquid entering each successive distributor ring 48 is distributed by apertures 49 against flue 46 while directing the liquid into the next succeeding distributor ring 48 for redistribution. In this manner, liquid deposited in distributor rings 48 is sequentially diverted in a non-linear path down the external surface of flue 46.

Figure 2:
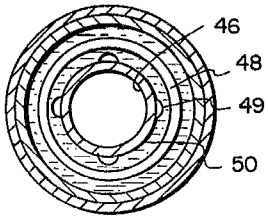
FIG. 2 is a cross-section taken along lines 2—2 of FIG. 1.

With particular reference also to FIG. 2, the interrelationship between distributor ring 48, apertures 49 and flue 46 is more clearly illustrated, particularly since the liquid 50 is supported by each successive distributor ring 48 until passed downwardly through apertures 49 to the next succeeding distributor ring 48.

Referring again to FIG. 1, liquid 50 collects as a pool adjacent the lower end of distiller 12 and receives additional heat energy from heat transfer discs 52 immersed therein. It should be noted that the distiller 12 is essentially a countercurrent heat exchanger apparatus with the incoming liquid being introduced adjacent the upper, cooler end while the pool of liquid 50 collects adjacent the lower, hot end adjacent flames 44. During the traversal through the various distributor rings 48, the incoming liquid from inlet conduit 95 is selectively vaporized to separate working fluid therein to create a high-pressure vapor within distiller 12.

The high-pressure vapor passes through a check valve 54 into a conduit 56 for passage into superheater 14. Superheater 14 is configurated as a cylindrical column 58 having an insulative layer 59 surrounding the same and also includes a combustion chamber 60 with a coaxial flue 66 extending upwardly from combustion chamber 60.

Figure 4:
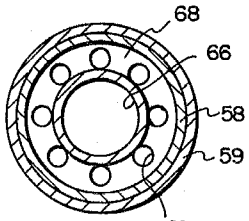
FIG. 4 is a cross-section taken along lines 4—4 of FIG. 1.

With reference also to FIG. 4, superheater 14 includes a plurality of heat exchange discs 68 transecting the annular space of column 58 surrounding flue 66. Each of discs 68 includes a plurality of apertures 69 therein, the apertures permitting the flow of vapor downwardly in countercurrent heat exchange relationship through superheater 14 into conduit 70.

A control valve 34 operated by controller 35 directs the superheated working fluid vapor into the mechanical expansion engine 16 where the thermal energy therein is converted to mechanical energy. Mechanical energy is transmitted by belts 100 and 101 to generator 28 and pump 30 and fan 24, respectively. The exhausted working fluid is removed from expansion engine 16 through conduit 72 where it is introduced into absorption column 18.

Figure 3:
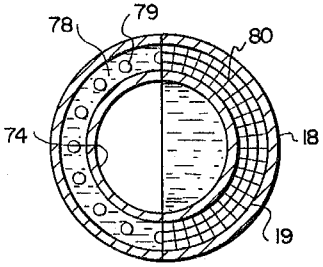
FIG. 3 is a cross-section taken along lines 3—3 of FIG. 1.

Referring also to FIG. 3, absorption column 18 includes an external, cylindrical shell 19 with a coaxial vapor-receiving chamber 74 therein. Chamber 74 includes a conical section 76 at the upward end thereof and is supported in spaced relationship inside shell 19 by a distributor ring 78 having a plurality of apertures 79 therein. The annular space between chamber 74 and shell 19 is filled with a coil of finned heat exchange tubes 80 coiled thereabout and extending between an inlet 93 and an outlet 94.

In operation, the incoming exhaust vapor from conduit 72 is introduced into chamber 74 and escapes outwardly through a plurality of apertures 75 into the surrounding liquid. The liquid is the solvent or bottom product from distiller 12 and is introduced adjacent the apex of cone 76 and substantially filling the annular space surrounding chamber 74. As is well-known in the art, the vapor being absorbed into the solvent to form the solution generates or otherwise releases thermal energy in the form of heat of absorption. This thermal energy is absorbed by solution passing through finned heat exchange tubes 80 and removed by conduit 94. The solution collects as a pool 90 in the lower end of absorption column 18 and is withdrawn through conduit 92 into a cooler 22. Cooler 22 is used to remove a portion of the residual heat in the solution prior to passing the same through conduit 93 by means of pump 30 and thereafter through finned tubes 80. The solution is withdrawn through conduit 94 and passed through a countercurrent heat exchanger 32 prior to being re-introduced into distiller 12 through conduit 95. The relatively pure solvent produced in distiller 12 and indicated as the liquid 50 is withdrawn through check valve 55 through conduit 96 where it is passed in heat exchange relationship through countercurrent heat exchanger 32 and then directed by conduit 97 into cooler 20 for the removal of additional residual heat. Thereafter, the solvent is directed by conduit 98 and controlled by control valve 36 operated by controller 37 where it is introduced into the absorption column 18.

Importantly, absorption column 18 provides intimate contact between the exhaust working fluid vapor from turbine 16 and the incoming solvent through conduit 98 to thereby suitably absorb the working fluid vapor with the solvent and release heat of absorption while producing solution 90. The resulting heat of absorption is recovered by solution 90 being directed through finned heat exchange tubes 80.

In summary, distiller 12 efficiently utilizes heat energy supplied by flame 44 to separate the working fluid from the solution leaving a pool of solvent 50 therein. The vaporized working fluid is thereafter suitably superheated in superheater 14 prior to passing through mechanical expansion engine 16 where thermal energy therein is converted to mechanical energy. Thereafter, the working fluid vapor is suitably absorbed in the solvent 50 to substantially reduce the backpressure to mechanical expansion engine 16 for increased efficiency while releasing the heat of absorption which may be recovered and suitably utilized.

Figure 5:
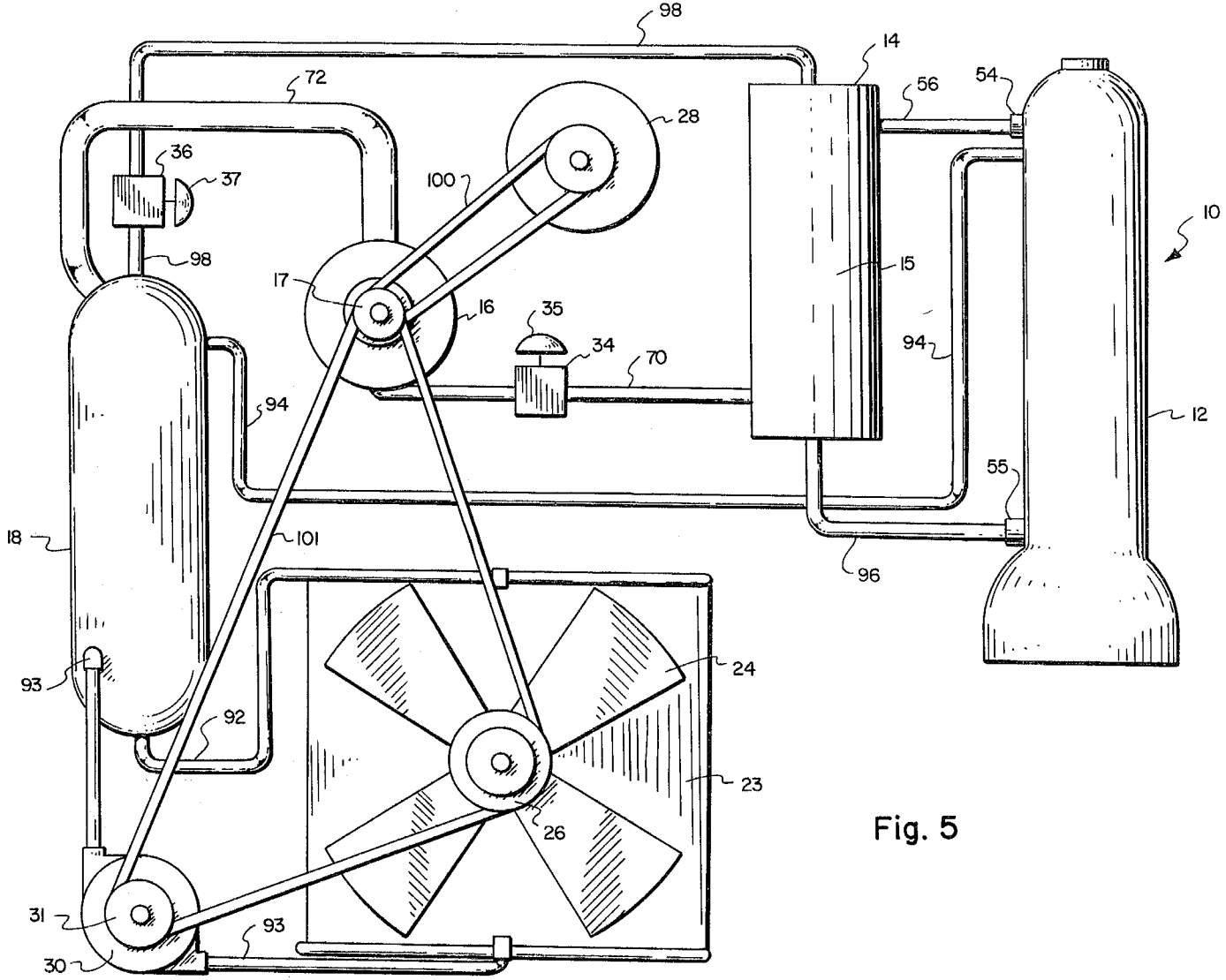
FIG. 5 is a schematic diagram of a second preferred embodiment of the novel apparatus of this invention.

Referring now more particularly to FIG. 5, a second preferred embodiment of the regenative absorption engine apparatus of this invention is shown wherein the primary modification relates to the superheater 14. In particular, superheater 14 is configurated as a cylindrical column 15 and is constructed as a countercurrent heat exchanger wherein solvent 50 (FIG. 1) from adjacent the lower end of distiller 12 is removed through check valve 55 and directed by conduit 96 in countercurrent heat exchange relationship with working fluid vapor withdrawn through check valve 54 and conduit 56. Additional thermal energy is transferred to the working fluid vapor prior to its passing through conduit 70 and check valve 34 into mechanical expansion engine 16. The cooled solvent 50 is thereafter directed through control valve 36 and inlet conduit 98 into absorption column 18. The primary difference in the apparatus of this preferred embodiment of the invention resides in the utilization of a countercurrent heat exchanger apparatus in place of the external combustion source of superheater 14 with the concurrent elimination of countercurrent heat exchanger 32 and cooler 20 (FIG. 1). Accordingly, the sole source of external heat energy is supplied through distiller 12 with superheater 14 serving to superheat the working fluid vapor with the solvent from distiller 12.

While the apparatus and method of this invention as set forth in each of FIGS. 1 and 5 is primarily directed to a single stage system utilizing a superheater apparatus between the distiller and the mechanical expansion engine, it should be clearly understood that a series of stages may be incorporated whereby working fluid exhaust passing through conduit 72 would be directed to a second superheater (not shown) prior to being introduced into a second thermal expansion engine (not shown). Accordingly, a series of stages utilizing the principles disclosed herein could be readily provided following the teachings set forth herein.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes that come within the meaning and range of equivalency of the claims are to be embraced within their scope.

What is claimed and desired to be secured by a U.S. Letters Patent is:

1. A regenative absorption engine comprising:

a closed cycle system comprising a first fluid having a first, lower boiling point and a second fluid having a second, higher boiling point, said second fluid having a relatively high degree of absorptivity for the first fluid;

distillation means for separating the first fluid from the second fluid by selectively vaporizing the first fluid, the distillation means comprising a first column having a coaxial first flue in spaced relationship inside the first column and a plurality of perforated, inverted, frustoconical distributor rings mounted to the first flue, the distributor rings directing incoming third fluid into thermal contact with the first flue for more efficient heat transfer into the third fluid, the third fluid including the first fluid and the second fluid, the trays being spaced from the internal wall of the first column for the upward passage of vaporized first fluid inside the first column, the first flue directing heated combustion products upwardly through the first column;

superheater means for superheating the vaporized first fluid;

mechanical expansion engine means downstream of the superheater means, the mechanical expansion engine means converting thermal energy of the first fluid into mechanical energy; and absorption means downstream of the mechanical expansion engine means, the absorption means providing absorption of the first fluid from the mechanical expansion engine means with the second fluid while reducing backpressure in the first fluid, the absorbed first fluid in the second fluid comprising a third fluid.

2. The regenative absorption engine defined in claim 1 wherein the superheater means comprises a second column having a coaxial, second flue in spaced relationship inside the second column and a plurality of perforated, heat transfer plates transacting the annular space in the second column between the second flue and the second column, the second flue directing heated combustion products upwardly through the second column.

3. The regenative absorption engine defined in claim 1 wherein the distillation means further comprises heat exchange means for removing heat energy from the third fluid from the absorption means by passing second fluid from the distillation means in heat exchange relationship with the third fluid.

4. The regenative absorption engine defined in claim 3 wherein the distillation means further comprises a second cooler means downstream of the heat exchange means, the second cooler means removing heat energy from the second fluid prior to introducing the second fluid into the absorption means.

5. A regenative absorption engine comprising:

a closed cycle system comprising a first fluid having a first, lower boiling point and a second fluid having a second, higher boiling point, said second fluid having a relatively high degree of absorptivity for the first fluid;

distillation means for separating the first fluid from the second fluid by selectively vaporizing the first fluid;

superheater means for superheating the vaporized first fluid;

mechanical expansion engine means downstream of the superheater means, the mechanical expansion engine means converting thermal energy of the first fluid into mechanical energy; and absorption means downstream of the mechanical expansion engine means, the absorption means providing absorption of the first fluid from the mechanical expansion engine means with the second fluid while reducing backpressure in the first fluid, the absorbed first fluid in the second fluid comprising a third fluid, the absorption means comprising a vessel having contact means for contacting the second fluid with the first fluid, the contact means comprising a perforated chamber coaxially spaced inside the vessel and having an inlet for the first fluid, the perforated chamber adapted to being immersed in second fluid thereby providing intermixing of the first fluid with the second fluid upon the first fluid passing from the chamber through the perforations and into the second fluid.

6. The regenative absorption engine defined in claim 5 wherein the absorption means further comprises heat exchange means for absorbing heat of absorption produced when the first fluid is absorbed by the second fluid, the heat exchange means carrying third fluid through the annular space between the vessel and the chamber.

7. The regenative absorption engine defined in claim 6 wherein the heat exchange means comprises a coil of heat exchange tubing surrounding the chamber.

8. The regenative absorption engine defined in claim 5 wherein the absorption means further comprises a first cooler means for removing thermal energy from the third fluid.

9. A regenative absorption engine system comprising:

a closed cycle containing a first fluid and a second fluid, the first fluid having a first, relatively low boiling point, the second fluid having a second, relatively higher boiling point and a relatively high degree of absorptivity for the first fluid, the absorbed first fluid in the second fluid comprising a third fluid;

distillation means for selectively vaporizing the first fluid to separate the first fluid from the third fluid to leave the second fluid, said distillation means comprising a first column having a coaxial first flue in spaced relationship inside the first column and a plurality of perforated, inverted, frustoconical distributor rings mounted to the first flue, the distributor rings directing incoming third fluid into thermal contact with the first flue for more efficient heat transfer into the third fluid, the third fluid including the first fluid and the second fluid, the trays being spaced from the internal wall of the first column for the upward passage of vaporized first fluid inside the first column, the first flue directing heated combustion products upwardly through the first column;

superheater means for increasing the thermal energy of the vaporized first fluid from the distillation means;

mechanical expansion engine means downstream of the superheater means, the mechanical expansion engine means converting thermal energy in the first fluid from the superheater means into mechanical energy;

absorption means downstream of the mechanical expansion engine means, the absorption means lowering the backpressure in the first fluid from the mechanical expansion engine means by absorbing the first fluid with the second fluid to form the third fluid; and heat exchange means for removing heat of absorption produced upon absorbing the first fluid with the second fluid.

10. The regenative absorption engine system defined in claim 9 wherein the heat exchange means comprises a first heat exchanger, a second heat exchanger, a first cooler and a second cooler, the first heat exchanger being in thermal contact with the third fluid in the absorption means and absorbing heat energy in the form of heat of absorption therefrom with third fluid that has been cooled in the first cooler, the second heat exchanger providing a heat exchange relationship between the third fluid from the first heat exchanger and the second fluid from the distillation means, the second fluid thereby absorbing heat energy in the second heat exchanger with the second cooler removing the heat energy from the second fluid downstream of the second heat exchanger and upstream of the absorption means.

11. A regenative absorption engine system comprising:

a closed cycle system comprising a first fluid having a first, lower boiling point and a second fluid having a second, higher boiling point, said second fluid having a relatively high degree of absorptivity for the first fluid;

distillation means for separating the first fluid from the second fluid with heat energy;

heat exchange means for passing the first fluid in heat exchange relationship with the second fluid thereby superheating the first fluid;

mechanical expansion engine means downstream of the heat exchange means, the mechanical expansion engine means converting thermal energy of the first fluid into mechanical energy; and absorption means downstream of the mechanical expansion engine means, the absorption means providing absorption of the first fluid with the second fluid while reducing backpressure in the first fluid; said absorption means comprising a vessel having a contact means for contacting the first fluid with the second fluid, said contact means comprising a perforated chamber coaxially spaced inside the vessel and having an inlet for the first fluid, the perforated chamber adapted to being immersed in second fluid thereby providing intermixing of the first fluid with the second fluid upon the first fluid passing from the chamber through the perforations and into the second fluid.

* * * * *